US005892301A

United States Patent [19]

Warnatz

[11] Patent Number: 5,892,301

[45] Date of Patent: Apr. 6, 1999

[54] MECHANICAL AND-MEMBER FOR MUTUALLY LOCKING POWER SWITCHES

[75] Inventor: Peter Warnatz, Berlin, Germany

[73] Assignee: Siemens Aktiengesellschaft, Munich, Germany

[21] Appl. No.: 913,030

[22] PCT Filed: Mar. 1, 1996

[86] PCT No.: PCT/DE96/00412

§ 371 Date: Nov. 24, 1997

§ 102(e) Date: Nov. 24, 1997

[87] PCT Pub. No.: WO96/27890

PCT Pub. Date: Sep. 12, 1996

[30] Foreign Application Priority Data

Mar. 6, 1995 [DE] Germany ..... 195 08 808.5

[51] Int. Cl.[6] ..... H01H 35/00

[52] U.S. Cl. ..... 307/119; 74/501.5 R; 74/500.5

[58] Field of Search ..... 307/116, 119; 74/501.5 R, 500.5

[56] References Cited

U.S. PATENT DOCUMENTS 4,788,453 11/1988 Bohnen et al. ..... 307/119
5,138,898 8/1992 Pospisil et al. ..... 74/502

FOREIGN PATENT DOCUMENTS 36 11 020 10/1987 Germany .

*Primary Examiner*—Jeffrey Gaffin
*Assistant Examiner*—Edwin D. Garlepp
*Attorney, Agent, or Firm*—Kenyon & Kenyon

[57] ABSTRACT

A mechanical AND element (U) serves for mutual locking of power switches (LS1, LS2, LS3). A carrier (T) serves as the stop for three flexible transmission members (S1, S2, S3) whose Bowden cables (S7, S8, S9) with parallel longitudinal axes act upon a coupling carriage (K). The Bowden cables (S7, S8) for the input signals (E1, E2) work in opposite directions and are engaged with the coupling carriage (K) at the outside and approximately in the center, respectively. The Bowden cable (S9) for the output signal (A) is connected to the other, outer, side of the coupling carriage (K).

3 Claims, 2 Drawing Sheets

MECHANICAL AND-MEMBER FOR MUTUALLY LOCKING POWER SWITCHES

FIELD OF THE INVENTION

The present invention relates to a mechanical AND element for mutual locking of multiple power switches.

BACKGROUND INFORMATION

German Patent No. 44 09 172 A1 describes a mechanical AND element in which Bowden cables are prestressed by springs with respect to a coupling carriage. The device described therein requires that the spring forces be adjusted accurately.

German Patent No. 36 11 020 A1 describes another AND element, similar to the AND element described above, in which flexible transmission members are designed as wire trip elements that transmit compressive forces. The coupling carriage is displaced by a wire trip element for a first input signal and also serves as a carrier of the wire trip element for the second input signal. In this way, a complete stroke occurs at the output of the AND element only when both input signals are present. This type of operation, however, requires that the wire trip element for the second input signal be carried displaceably. Furthermore, careful adjustment of all wire trip elements is required to ensure that the wire trip element for the output signal is properly actuated and therefore that the desired action takes place only with a full stroke of the two wire trip elements for the input signals. For this reason, with the AND element described therein, a stepped intermediate lever is provided between the coupling carriages and the wire trip element for the output signal to change the transmission ratio.

SUMMARY OF THE INVENTION

The present invention relates to a mechanical AND element for mutual locking of three power switches in which each power switch is provided with a flexible transmission member, where two of the transmission members can be actuated as a function of the position of the respective power switch in the sense of an input signal to be supplied to the AND element, and the remaining transmission member can be actuated by simultaneous actuation of the first two transmission members in the sense of an output signal to be transmitted to the third power switch. The AND element has a carrier as well as a coupling carriage that is mobile relative to the carrier. Each flexible transmission member has a sheath and a Bowden cable that is displaceable in the sheath, with the carrier being designed as a stop to support the sheaths. The transmission members are connected to the carrier so that the Bowden cables enter the AND element with parallel longitudinal axes. For connection with the coupling carriage, each Bowden cable is provided with a driver ring. The coupling carriage is designed as a beam running across the longitudinal axes of the Bowden cables and accommodating the driver rings of the Bowden cables with a mutual spacing. The Bowden cable transmitting the output signal is connected to the coupling carriage in the outside position, while the Bowden cable for one of the input signals is connected to the coupling carriage approximately at the center, and the Bowden cable provided for the remaining input signal is connected to the coupling carriage opposite the Bowden cable transmitting the output signal. The Bowden cables provided for the input signals are arranged with opposite directions of action.

An object of the present invention is to simplify the design of a mechanical AND element and ensure reliable operation. In accordance with the present invention, the driver ring works together with the coupling carriage in the sense of a free-wheeling coupling so that only tensile forces can be transmitted between the coupling carriage and the Bowden cables. In the non-actuated idle state of the AND element, the driver ring of the Bowden cable that is connected to the coupling carriage in the center position and the driver ring of the Bowden cable for the output signal are engaged with the coupling carriage, while the driver ring of the Bowden cable in the outer position for one input signal is opposite the coupling carriage with a distance so that the coupling carriage can be pivoted about the driver ring of the Bowden cable mounted in the outer position when the Bowden cable attached in the center position is actuated.

An AND element according to the present invention has the property that only a complete stroke of the Bowden cables for the input signals actuates the Bowden cable for the output signal. If there is only one input signal, the Bowden cable for the output signal remains at rest.

In contrast to known AND elements, only tensile forces are transmitted with the AND element according to the present invention. As a result, the Bowden cables of the flexible transmission elements can be connected directly to the coupling carriage. Therefore, the use of special guide devices for the coupling carriage can be omitted within the scope of the present invention. Instead, the coupling carriage can be guided on the carrier by the Bowden cables alone. The coupling carriage is aligned with the Bowden cables in this way. Such an arrangement has an especially low friction level and it is subject to practically no wear.

Given an AND element with adequate dimensions, the relative change in spacing of the Bowden cables when pivoting the coupling carriage is so small that it is not necessary to use special devices to compensate for the misalignment. However, if the goal is to design a small and compact AND element for use with power switches of compact dimensions, it is advisable for the coupling carriage to have longitudinal holes running in its longitudinal direction, each one to accommodate a slider for the passage of the Bowden cables provided for the input signals. With this arrangement, the coupling carriage is aligned according to the remaining third Bowden cable which is provided for the output signal.

DETAILED DESCRIPTION

Figure 1:
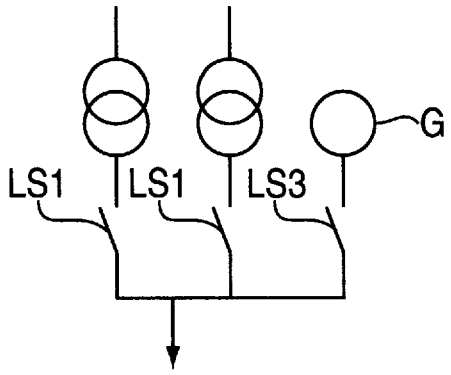
FIG. 1 shows a schematic representation of three power switches.

FIG. 1 shows a schematic diagram with three power switches LS1, LS2 and LS3. Power switches LS1 and LS2 are each provided for one input to a network through a transformer, while power switch LS3 is provided for an emergency generator G. In such a circuit, for operational reasons, power switch LS3 must be open when one of power switches LS1 or LS2 is closed.

FIGS. 2 through 6 illustrate a mechanical AND element U, for achieving the object of mutual interlocking of the power switches LS1, LS2, and LS3. First, the design of the AND element is explained with reference to FIGS. 2 and 3. AND element U has a carrier T made of sheet metal, for example, with the top and bottom edges bent twice to form edge web T1. Orifices T2 are provided to permit any desired attachment of AND element U in a switchgear or on a power switch. The bent edges of carrier T serve as stops for three flexible transmission members S1, S2, and S3, each of which has a sheath S4, S5, or S6 and a Bowden cable S7, S8, or S9 guided in sheath S4, S5 or S6. An end piece S10 is provided to support sheaths S4, S5, and S6 of flexible transmission members S1, S2, and S3. Bowden cables S7, S8, and S9 have parallel longitudinal axes in the area of AND element U.

Figure 2:
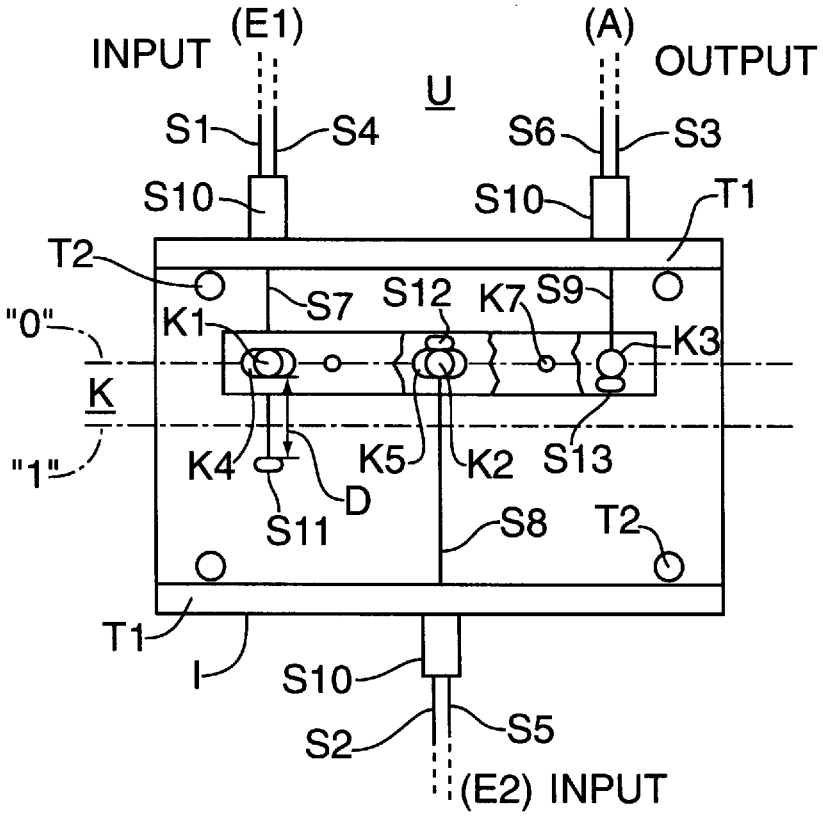
FIG. 2 schematically shows the top view of an AND element.
Figure 3:
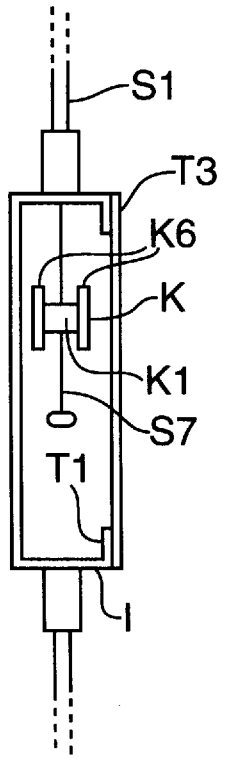
FIG. 3 schematically shows the side view of an AND element.

Bowden cables S7, S8, and S9 are connected to a beam-like coupling carriage K comprising two parallel sheet metal parts K6, as shown in FIG. 3. The two sheet metal parts K6 are connected by riveted spacers K7. The Bowden cables S7, S8, and S9 each pass through a cylindrical slider K1, K2 or K3 that engages in opposing orifices in coupling carriage K. The orifices for sliders K1 and K2 are designed as elongated holes K4 and K5. Thus, the coupling carriage K is in a floating mount on carrier T through the connection with Bowden cables S7, S8, and S9. A protective cover T3, as illustrated in FIG. 3, is placed on edge webs T1 only to secure coupling carriage K in the relaxed state of Bowden cables S7, S8, and S9. Protective cover T3 has been omitted in FIG. 2 so that coupling carriage K is completely visible. Each Bowden cable S7, S8, and S9 is provided with its own driver ring S1, S12, or S13. As shown in FIGS. 2 and 3, driver rings S12 and S13 are engaged with sliders K2 and K3, whereas driver ring S11 is a distance D away from slider K1.

The arrangement of transmission members S1, S2, and S3 relative to coupling carriage K is important for the operation of AND element U. As FIG. 1 shows, Bowden cables S7 and S8, provided for input signals E1 and E2, of transmission members S1 and S2 engage with coupling carriage K in opposite directions. Bowden cable S9 of transmission member S3 for output signal A is arranged parallel to Bowden cable S7 and engages with the opposite side of coupling carriage K. Bowden cable S8 of transmission member S2 for input signal E2 engages approximately with the center of coupling carriage K and acts in the opposite direction compared to Bowden cables S7 and S9.

Transmission members S1 and S2 are each assigned to an input signal E1 or E2, while transmission member S3 serves to transmit output signal A. In the status of AND element U according to FIGS. 2 and 3, no input signal E1 or E2 is present. Accordingly, coupling carriage K is in an idle position, where it is aligned with a basic position indicated with a dash-dot line at "0" in the figure. The notation for input signals E1 and E2 and output signal A is shown in parentheses to indicate that these signals are not active.

Figure 4:
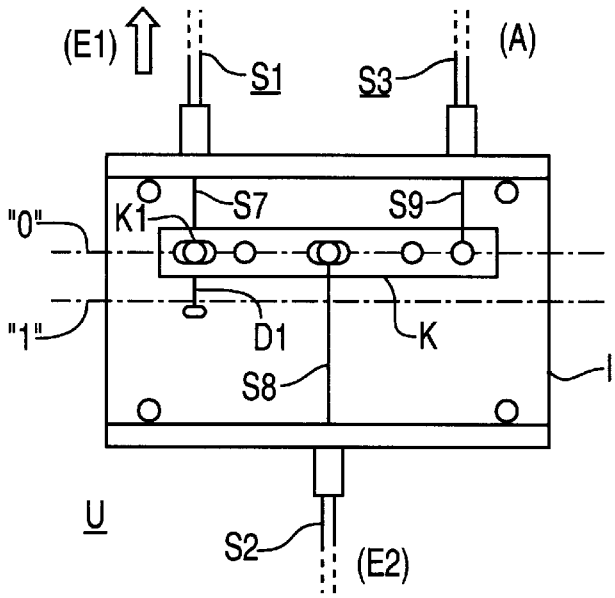
FIG. 4 shows the AND element according to FIGS. 2 and 3 when an input signal is present.

FIG. 4 illustrates the status where an input signal E1 is acting on Bowden cable S7. Driver ring S11 is opposite slider K1 at a distance that is no longer D but a shorter distance D1. Coupling carriage K thus remains deactivated so that no output signal A is delivered.

Figure 5:
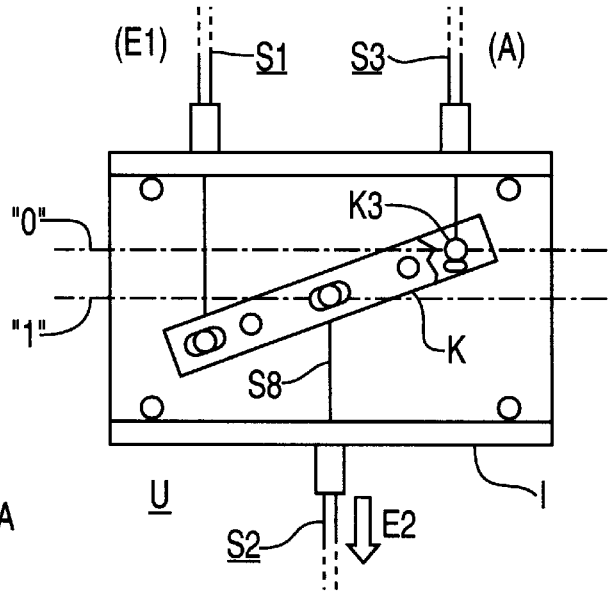
FIG. 5 shows the AND element of FIGS. 2 and 3 when a second input signal is present.

FIG. 5 shows that coupling carriage K assumes an inclined position when an input signal E2 is present instead of input signal E1. The Bowden cable S8 for the output side of AND element U remains at rest, however, which can be seen by the fact that slider K3 remains in reference plane "0" with no change.

Figure 6:
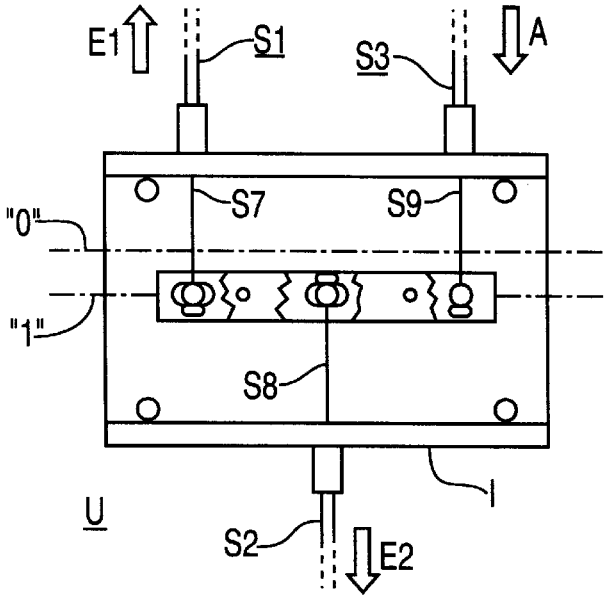
FIG. 6 shows the AND element of FIGS. 2 and 3 when both input signals are present and an output signal is delivered.

However, if both input signals E1 and E2 arrive, as illustrated in FIG. 6, coupling carriage K is entrained and displaced from reference plane "0" into lower reference plane "1". In the process, the Bowden cable S9 is actuated, which corresponds to delivery of output signal A. This serves to block power switch LS3 (FIG. 1) in a known way to prevent its actuation when input signals E1 and E2 are supplied due to the closing of power switches LS1 and LS2.

I claim:

1. A mechanical AND device for mutually locking a plurality of power switches, the device comprising:

a plurality of flexible transmission members, each transmission member corresponding to one of the plurality of power switches, wherein first and second of the transmission members can be actuated as a function of a position of the respective power switch and wherein a third transmission member can be actuated by simultaneous actuation of the first and second transmission members, each transmission member including a sheath and a Bowden cable, the Bowden cable of each transmission member being displaceable in the corresponding sheath and being provided with a driver ring;

a carrier, the carrier including a stop to support the sheaths of the transmission members, wherein the transmission members are connected to the carrier so that the Bowden cables enter the AND device substantially parallel to each other; and a coupling carriage, wherein the coupling carriage is movable relative to the carrier, includes a beam running across the longitudinal axes of the Bowden cables and accommodates the driver rings of the Bowden cables with a mutual spacing, wherein:

the Bowden cable of the first transmission member is connected to a first point on the coupling carriage proximate to a first end of the coupling carriage, the Bowden cable of the second transmission member is connected to a second point on the coupling carriage proximate to a center of the coupling carriage and the Bowden cable of the third transmission member is connected to a third point on the coupling carriage proximate to a second end of the coupling carriage, the Bowden cables of the first and second transmission lines are arranged with opposite directions of travel, the driver rings cooperate with the coupling carriage as free-wheeling couplings so that tensile forces can be transmitted between the coupling carriage and the Bowden cables, in an idle state of the device, the driver ring of the Bowden cable of the second transmission member and the driver ring of the Bowden cable of the third transmission member are engaged with the coupling carriage, while the driver ring of the Bowden cable of the first transmission member is at a first distance from the coupling carriage, so that the coupling carriage can be pivoted about the driver ring of the Bowden cable of the third transmission member when the Bowden cable of the second transmission member is actuated.

2. The mechanical AND device of claim 1, wherein the coupling carriage is guided on the carrier by the Bowden cables.

3. The mechanical AND device of claim 1, wherein the coupling carriage has elongated holes running along a longitudinal direction of the carriage, each elongated hole accommodating a slider, each slider slidably engaging one of the Bowden cables of the first and second transmission members.

* * * * *